US006662596B2

(12) United States Patent
Tsutsumi

(10) Patent No.: US 6,662,596 B2
(45) Date of Patent: Dec. 16, 2003

(54) FRAGRANCE DIFFUSER

(75) Inventor: Yoji Tsutsumi, Hyogo (JP)

(73) Assignee: Imex Co., Ltd., Osaka (JP)

( * ) Notice: Subject to any disclaimer, the term of this patent is extended or adjusted under 35 U.S.C. 154(b) by 0 days.

(21) Appl. No.: 10/254,915

(22) Filed: Sep. 26, 2002

(65) Prior Publication Data

US 2003/0061831 A1 Apr. 3, 2003

(30) Foreign Application Priority Data

Sep. 28, 2001 (JP) ..... 2001-302144
Jul. 26, 2002 (JP) ..... 2002-218226

(51) Int. Cl.[7] ..... A44C 13/00

(52) U.S. Cl. ..... 63/1.15; 63/12; 63/DIG. 2; 24/705

(58) Field of Search ..... 63/12, 1.14, 1.15, 63/DIG. 2; 24/705

(56) References Cited

U.S. PATENT DOCUMENTS 511,952 A * 1/1894 Hubash ..... 606/188
1,267,067 A * 5/1918 Flagg ..... 63/14.6
4,056,951 A * 11/1977 Black ..... 63/13
4,159,631 A * 7/1979 Lee ..... 63/1.15
4,353,370 A * 10/1982 Evans ..... 604/289
4,452,052 A * 6/1984 Hodge ..... 63/1.15
5,031,419 A * 7/1991 Gelman ..... 63/12

* cited by examiner

*Primary Examiner*—Andrea Chop
(74) *Attorney, Agent, or Firm*—Wenderoth, Lind & Ponack, L.L.P.

(57) ABSTRACT

A fragrance diffuser is provided which keeps the tip of the pierced earring post from injuring the wearer by covering the tip of the pierced earring post of a pierced earring, thereby making the pierced earring harmless, and which can diffuse the fragrance of perfume for a much longer time. An outer case for covering the tip of the pierced earring post is provided and a catch for receiving the pierced earring post is mounted in the outer case. An absorbent member having a perfume impregnated therein is also mounted in the outer case. It is possible to avoid injury often inflicted by the tip of the earring post and enjoy fragrance of the perfume for a much longer time.

8 Claims, 5 Drawing Sheets

FRAGRANCE DIFFUSER

BACKGROUND OF THE INVENTION

This invention relates to a fragrance diffuser which can be attached to the post of a pierced earring or to a garment, necktie or hat to let fragrance diffuse.

An ordinary pierced earring has an ornamental member fixed to one end of the pierced earring post, and a pierced earring catch as a separate member for receiving the pierced earring post is provided. By inserting the business end of the pierced earring post in a hole formed in an earlobe and mounting the pierced earring catch on a desired point down the business end of the pierced earring post behind the earlobe, the ornamental member is disposed on the front side of the earlobe.

To enjoy the fragrance of a perfume, one usually puts perfume on a garment or directly on the skin.

When such a pierced earring is fitted on an earlobe, the sharp tip of the earring post sticks out from the pierced earing catch behind the earlobe. Thus, if the ear is pushed back accidentally for some reason, the wearer may be injured by the jutting sharp tip of the earring post.

Also, because pierced earring catches are extremely small, if they happen to fall or when put away and forgotten, they are often lost Once a catch is lost, its counterpart pierced earring itself cannot be put to use.

If perfume is put directly on the skin, skin disorder can occur. Also, if perfume is put on a garment, it will cause a stain to ensue.

An object of this invention is to provide a fragrance diffuser which prevents the tip of the pierced earring post from injuring the wearer by covering its tip, thereby making the pierced earring harmless, which can hardly be lost because of it larger size, and which can diffuse the fragrance of perfume for a much longer time from wherever it is perched on, that is, the ear, a garment, necktie, hat or the like.

SUMMARY OF THE INVENTION

According to this invention, there is provided a fragrance diffuser comprising a catch having a needle hole for receiving a needle of a member with the needle, an outer case for covering the tip of the needle which is inserted through the catch, and an absorbent member mounted in the outer case and having a fragrant material impregnated therein, the outer case having a fragrance diffusing portion for diffusing the fragrance of the fragrant material.

The outer case is shaped to mount the absorbent member therein and has a lid member for closing the open end of the outer case, the outer case being formed with at least one hole to provide the fragrance diffusing portion, the catch being fixed in the lid member so as to extend through the lid member.

The outer case is made of a hard resin and is shaped to be hollow and has a decorative shape and color. The absorbent member is made of cotton, felt or the like and is shaped to be mounted in the outer case The fragrance diffusing portion of the outer case is formed by a plurality of small holes which serve also as a perfume filling port.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
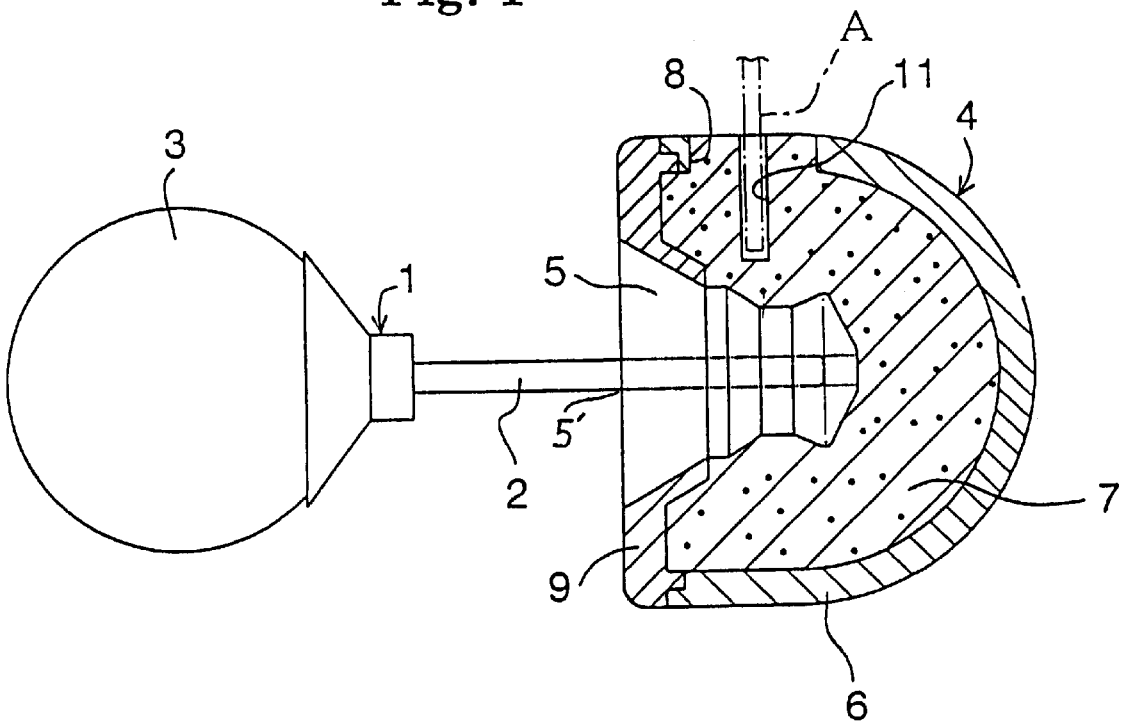
FIG. 1 is a sectional view showing how the fragrance diffuser according to this invention is fitted on a pierced earring.

Hereinbelow, the embodiments of this invention will be described with reference to the accompanying drawings.

A pierced earring 1 known as an ornament is formed by fixing an ornamental member 3 that can be of various designs and materials to one end of a pierced earring post (or needle) 2. It is usually used in combination with a pierced earring catch for receiving the pierced earring post 2.

The fragrance diffuser 4 of this invention is used in place of an ordinary pierced earring catch when using the pierced earring 1. The diffuser 4 has a catch 5 for receiving the needle 2 of the pierced earring 1 and a hollow outer case 6 for covering the tip of the needle 2 of the pierced earring 1, which is inserted through a needle hole 5' of the catch 5. An absorbent member 7 to be impregnated with a perfume is mounted in the outer case 6 which is provided with a fragrance-diffusing portion 8.

The catch 5 has a known structure to allow the needle 2 to be pushed in and pulled out and has an elastic body such as rubber mounted therein to catch the post 2.

The outer case 6 is made of a hard or soft resin and is formed so as to be hollow to cover the tip of the pierced earring needle 2. The outer case 6 includes a lid member 9 for closing the open end of the outer case 6 and the absorbent member 7 mounted in the outer case 6. The catch 5 extends through the lid member 9 in its center.

The outer case 6 is formed with a hole at a suitable position to provide the fragrance diffusing portion 8. If a magnetic material or a material that produces ions is used as the material of the outer case 6, a health promoting effect could be obtained.

As the absorbent member 7 shaped to be mounted in the outer case 6, cotton, felt, sponge or the like may be used. It is visible through the fragrance-diffusing portion 8 of the outer case 6 and the portion 8 serves also as a perfume filling port for the absorbent member 7.

In the embodiment of FIG. 1, the absorbent member 7 has a small hole 11 for inserting a spray nozzle A (if the perfume container is of a spray type). It is formed at its portion near the fragrance-diffusing portion 8.

The fragrance diffuser shown in FIG. 1 has its outer case 6 formed substantially semispherically. The opening of the outer case 6 is covered by the lid member 9. The end face of the catch 5 and the outer surface of the lid member 9 are flush with each other. The shape, pattern, color, material, etc. of the outer case 6 are not particularly limited, but may be selected freely. A decorative material such as nail art and skin art or a seal may be pasted to the outer surface of the outer case 6 to let the wearer enjoy her original art design.

Figure 2A:
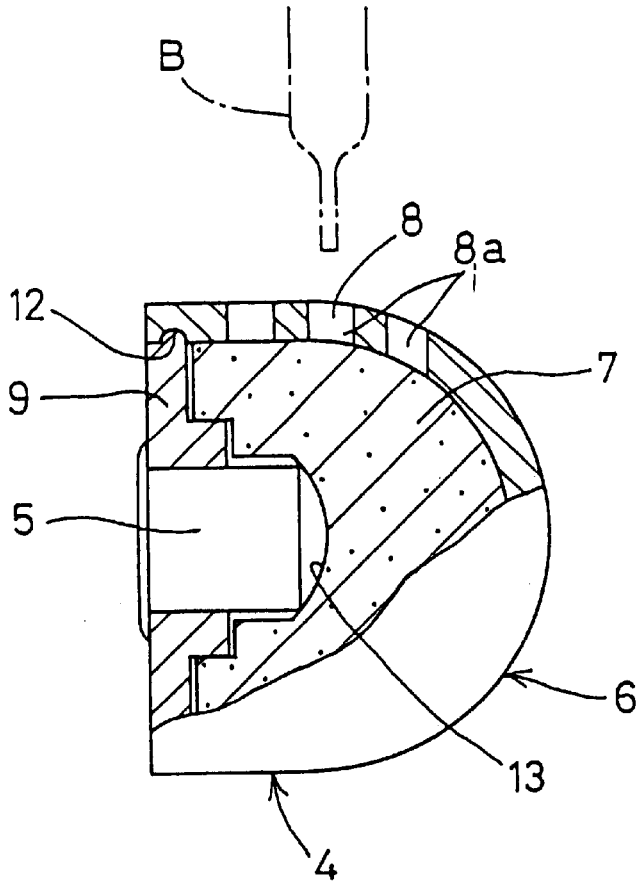
FIG. 2A is a sectional view of another embodiment of the fragrance diffuser.
Figure 3:
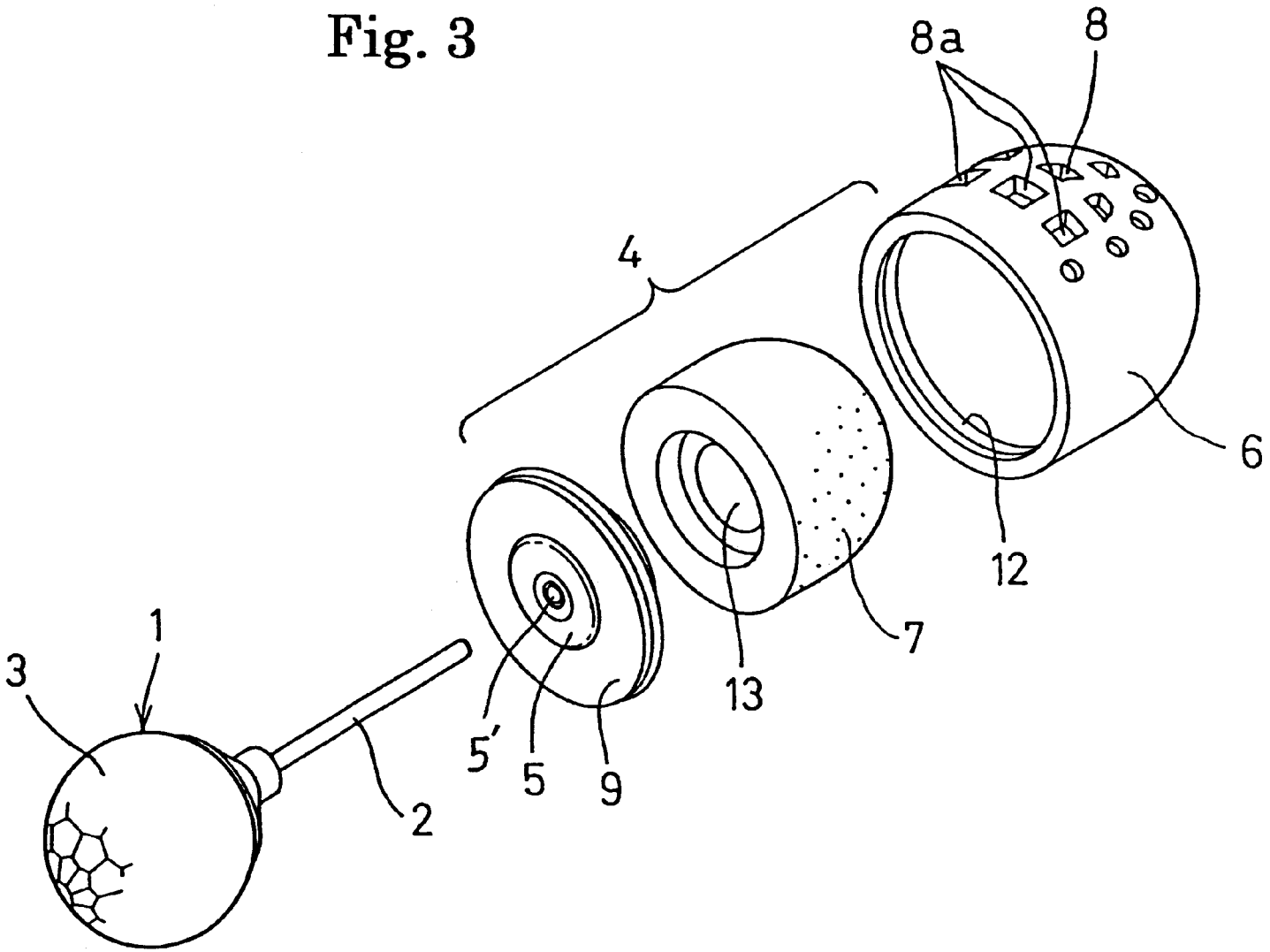
FIG. 3 is an exploded perspective view of the fragrance diffuser of FIG. 2A.
Figure 4A:
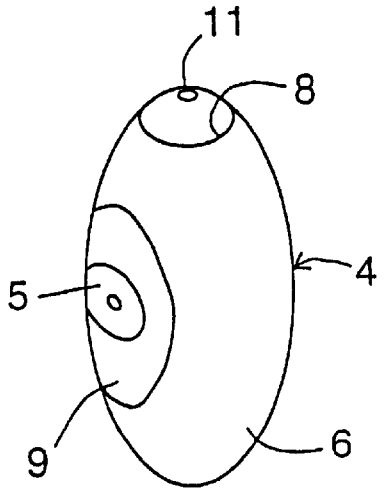
FIGS. 4A–4E are perspective views showing embodiments of fragrance diffusers having different shapes.
Figure 4B:
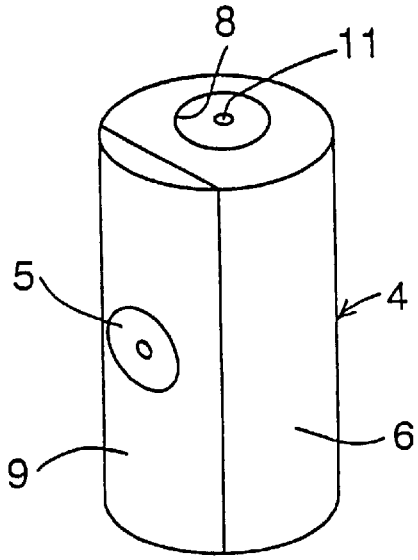
Figure 4C:
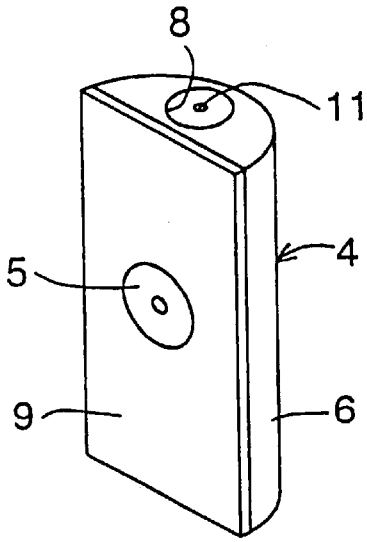
Figure 4D:
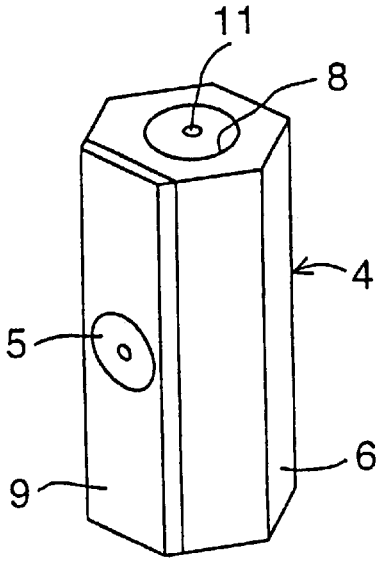
Figure 4E:
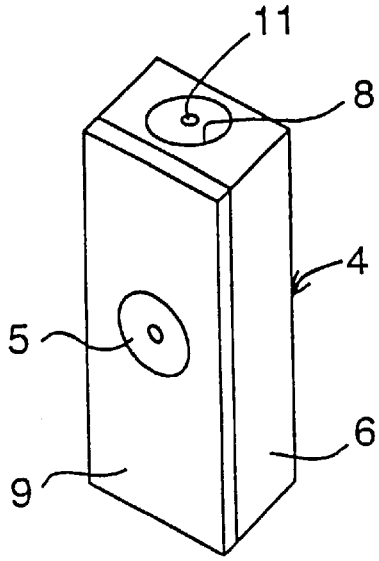

FIGS. 2A and 3 show another embodiment of the fragrance diffuser (or disperser). The outer case 6 is formed substantially semispherically. An open end of the outer case 6 is closed by fitting a disk-shaped lid member 9 in a groove 12 formed in the inner periphery of the open end of the outer case 6. The catch 5 is fixed to the center of the lid member 9 so as to extend therethrough. The absorbent member 7 is formed to have such a shape as to fit in the outer case 6 and has a recess 13 for receiving the protruding portion of the catch 5 and the tip of the pierced earring post 2. In the peripheral wall of the outer case 6, a plurality of circular or polygonal small holes 8*a* are formed to provide a dispersing portion 8.

The holes 8*a*, which form the dispersing portion 8, also serve as ports for charging perfume into the absorbent member 7 by use of a pipette B.

Figure 2B:
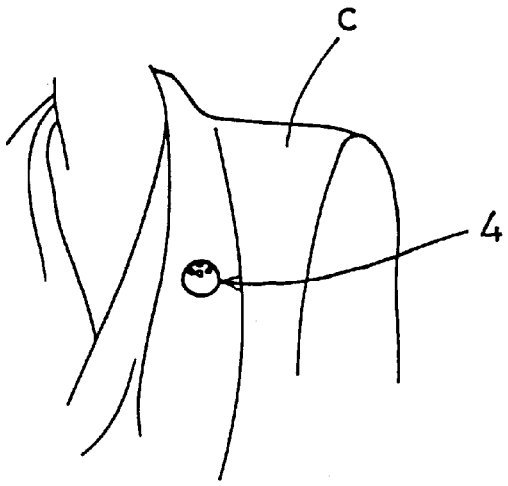
FIG. 2B is a front view showing how the fragrance diffuser of FIG. 2A is attached to a garment.
Figure 2C:
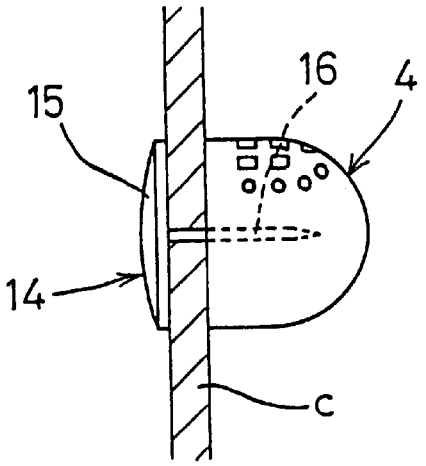
FIG. 2C is a sectional side view showing how the same is attached.

FIGS. 2B and 2C show another example of use of the fragrance disperser. One can enjoy the scent of perfume as well as decoration by mounting it on a garment C, tie, hat, etc. It is used in combination with a fastener 14 which is a member with a pointed needle.

The fastener 14 has a needle 16 protruding from a button plate 15. Its tip is pointed so that it can be stuck through the fabric of a garment C, tie or hat. To the button plate 15, the fragrance disperser 4 is mounted by sticking the needle 16 through the fabric and mounting the catch 5 on the stem of the needle 16.

The fragrance disperser 4 can be mounted so as to be located either on the outer surface of a garment C, tie, hat, etc., or on the inner side thereof to show the decorated button plate 15 on the outer surface instead of the inner side.

FIGS. 4A to 4E show several examples of different shapes of the fragrance diffuser 4. FIGS. 4A to 4E show a rugby ball shape, columnar shape, semicircular pillar, hexagonal pillar and square pillar, respectively. In any embodiment, an outer case 6 with a fragrance diffusing portion 8 is combined with a lid member 9 to which a catch 5 is fixed.

The fragrance diffuser 4 of this invention has such a structure. A pair of diffusers are sold in one set. When a pierced earring 1 is fitted on an ear, one of the diffusers is used in place of an ordinary catch of the pierced earring 1.

If intended to mount it on a garment, tie, hat, etc., the fragrance disperser 4 and the fastener 14 may be sold in one pair.

In use, perfume is supplied through the filling port, that is, the hole of the diffusing portion 8 to impregnate the absorbent member 7 with the perfume. In FIG. 1, a perfume container of a spray type is shown. A spray nozzle A in the form of a pipe having an extremely small diameter is inserted into the small hole 11 (FIG. 1) formed in the absorbent member 7 to inject perfume into the member 7 through the tip of the spray nozzle A. If the perfume container is of a cap type, it is possible to use a dropper pipette B or directly inject perfume from the bottle as shown in FIG. 2A.

If perfume is applied excessively to a garment, stain may develop on the garment. Also, if perfume is applied directly to the body, some people may develop a rash on the skin or may suffer from hair loss. In any case, most perfume dissipates in a short time, so that the sustaining effect is low, causing a problem.

In contrast, if the absorbent member 7 is impregnated with perfume, no trouble will be inflicted on garments or the skin. Also, perfume impregnated will not be lost in vain but fragrance will diffuse through the diffusing port 8 for a much longer time.

Figure 5:
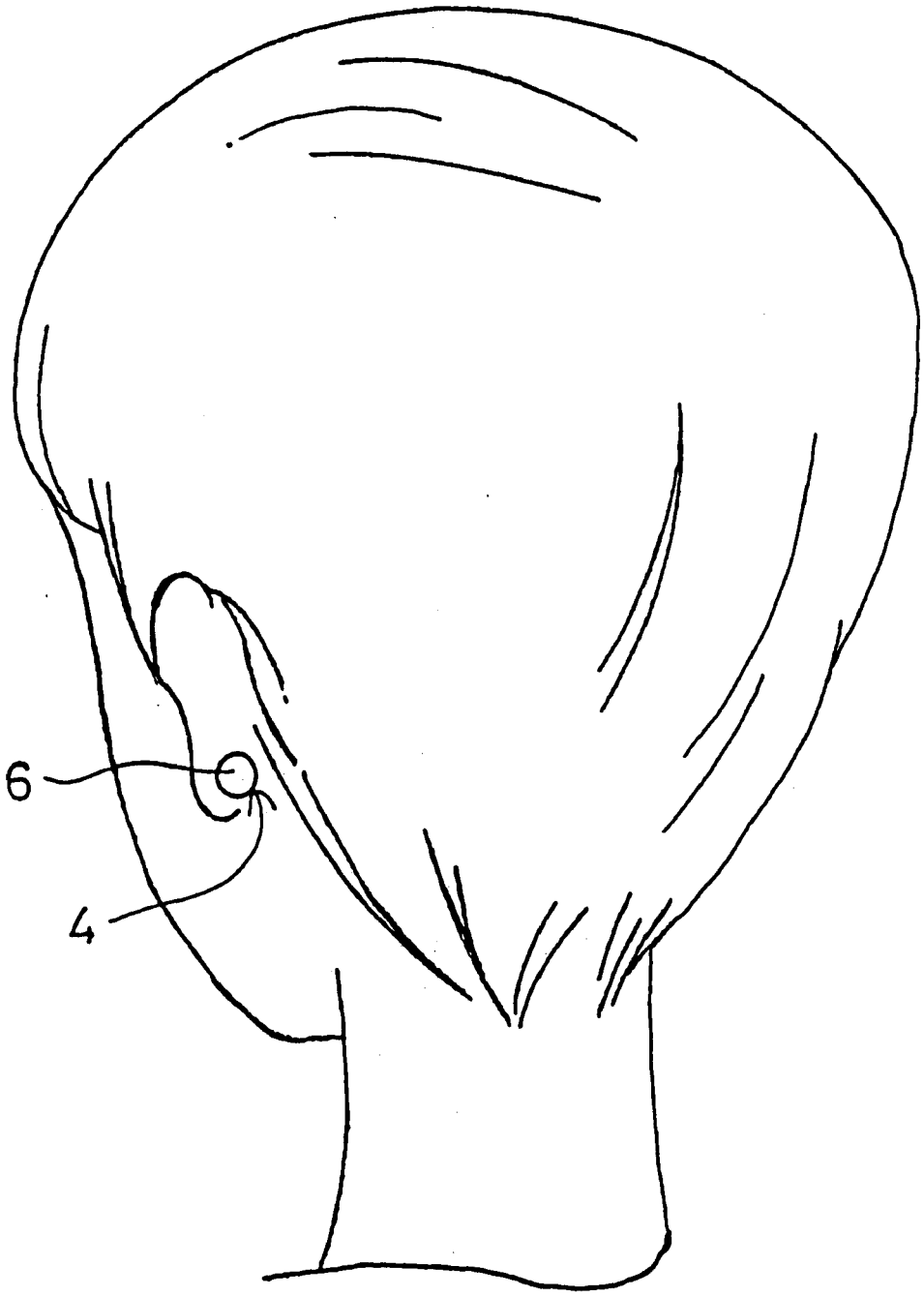
FIG. 5 is a perspective view showing how a pierced earring using the fragrance diffuser according to this invention is fitted on an earlobe.

By inserting the pierced earring post 2 into a hole in an earlobe with the pierced earring at the front, and fitting the catch 5 onto the pierced earring post 2, which has protruded from the back of the ear, the fragrance diffuser 4 is mounted as shown in FIG. 5 so that the pierced earring I will not fall off the ear.

The outer case 6 covers the tip of the pierced earring post 2 as shown in FIG. 1. Since it is covered so that the tip of the post 2 is not exposed, one will not be injured by the tip of the post 2. Thus safety is ensured.

If the fragrance disperser 4 is used mounted on a garment C, tie, hat, etc., the needle 16 of the fastener 14 is stuck through the fabric and the fragrance diffuser 4 is mounted to the needle 16 by means of the catch 5.

As described above, since the absorbent member 7 in the outer case 6 has perfume or a fragrance impregnated therein, fragrance will diffuse from the outer case 6 with the diffuser mounted on the pierced earring 1 or a garment. Thus, one can enjoy the fun of both new decorative effects and fragrance simultaneously.

By selling the outer case 6 separately from the pierced earring 1, one can combine and use an outer case 6 of a preferred shape with a pierced earring and enjoy various fashions. By combining it with the fastener 14, the fragrance disperser 4 can be mounted on e.g. a garment C. By providing the outer case 6, one can enjoy various fashions. Also, by changing the fragrance diffuser 4 to another one having a perfume that differs in fragrance, it is possible to change fragrance according to one's liking or TPO.

After detaching the fragrance diffuser 4, in which perfume is impregnated, from the pierced earring, and putting it in a sealed container or bag, fragrance will not be lost, saving the perfume.

According to this invention, since the outer case for covering the tip of the pierced earring post of the pierced earring inserted through the catch is provided on the pierced earring catch and the absorbent member to be impregnated with a fragrant material is mounted in the outer case which has a fragrance-diffusing portion, by covering the pierced earring post of the pierced earring fitted on an earlobe, it is possible to prevent the wearer from getting injured by the post and enhance safety by preventing the pierced earring post from being exposed. Also, one can enjoy fragrance for a much longer time. It is possible to enjoy fragrance of the perfume for a long time without applying it directly on garments and/or the skin.

Since the outer case is much larger than the pierced earring catch, it is conspicuous and less likely to be lost. Further, a new possibility for decoration is provided behind the earlobe.

Also, by combining a fastener with the outer case, it is possible to attach the fragrance member to a garment, tie or hat, and one can enjoy fragrance of perfume for a much longer time without putting perfume directly on a garment and/or the skin.

As shown, for example, in FIGS. 2A–2C and FIG. 3, the holes 8*a* of the diffusing portion 8 are formed only on one side of a central plane (i.e., a plane extending along the axis of the needle hole 5' of the catch 5).

What is claimed is:

1. A fragrance diffuser catch comprising a hollow shell defining a hollow space therein and comprising an outer case and a lid member fixed to said outer case and having a substantially planar outer surface, a catch member fixed to said lid member so as to extend through said lid member and made of an elastic material, said catch member having an outer surface substantially flush with said planar outer surface of said lid member and formed with a needle hole into which a needle portion of an article can be inserted, said needle hole having a longitudinal center axis which is substantially perpendicular to said planar outer surface of said lid member, and an absorbent member mounted in said hollow space of said hollow shell, said absorbent member being formed of a material which can absorb and retain a liquid fragrance, said outer case being formed with at least one through hole, said hollow space in said hollow shell being open to outside only through said at least one through hole, said at least one through hole being located on one side only of a plane containing said longitudinal center axis of said needle hole.

2. The fragrance diffuser catch of claim 1, wherein said catch member constitutes a catch member for receiving a post of a pierced earring.

3. A fragrance diffuser catch comprising:

a hollow shell defining a hollow space therein; and an absorbent member disposed in said hollow space and formed of a material to absorb and retain a liquid fragrance;

wherein said hollow shell comprises an outer case having an open end portion, and a lid member fixed to said outer case so as to close said open end portion;

wherein a catch member is fixed to said lid member so as to extend through said lid member, and said catch member includes a needle hole for receiving a needle portion of an article in such a manner as to releasably secure the needle portion so that the needle portion extends away from said hollow shell;

wherein said outer case is provided with at least one through hole to allow fragrance from the liquid fragrance retained in the absorbent member to emanate to outside said hollow shell from said hollow space; and wherein said lid member is free from any through holes that would allow fragrance from the liquid fragrance retained in the absorbent member to emanate to outside said hollow shell from said hollow space.

4. The fragrance diffuser catch of claim 3, wherein said catch member constitutes a catch member for receiving a post of a pierced earring.

5. The fragrance diffuser catch of claim 3, wherein said catch member is formed of an elastic material.

6. The fragrance diffuser catch of claim 3, wherein said needle hole defines an axis, and said at least one through hole is disposed only on one side of a plane that extends along said axis.

7. The fragrance diffuser catch of claim 3, wherein said lid member has a substantially planar outer surface.

8. The fragrance diffuser catch of claim 7, wherein said catch member has an outer surface substantially flush with said substantially planar outer surface of said lid member.

* * * * *